US005669747A

United States Patent [19]

Scharer

[11] Patent Number: 5,669,747

[45] Date of Patent: Sep. 23, 1997

[54] CODED COIL ELEMENT CARTRIDGE

[75] Inventor: Roger M. Scharer, Des Plaines, Ill.

[73] Assignee: General Binding Corporation, Northbrook, Ill.

[21] Appl. No.: 620,673

[22] Filed: Mar. 26, 1996

[51] Int. Cl.[6] ..... B42B 5/08

[52] U.S. Cl. ..... 412/38

[58] Field of Search ..... 412/9, 34, 38, 412/39, 40, 42, 43; 140/71 C; 221/69, 82

[56] References Cited

U.S. PATENT DOCUMENTS 4,844,674 7/1989 Tipps et al. ..... 412/38 X 4,846,616 7/1989 Abildgaard et al. ..... 412/7

5,383,756 1/1995 Coleman et al. ..... 412/38

*Primary Examiner*—Willmon Fridie, Jr.

*Attorney, Agent, or Firm*—Hill, Steadman & Simpson

[57] ABSTRACT

A cartridge box serves as supply container for a plurality of spiral coil elements and is thus suitable for use in a system for automated repetitive spiral binding of sheet stacks. The cartridge box contains the individual coil elements in a series of parallel rows. One elongated opening is formed in the cartridge box top or bottom surface to expose intermediate portions of the coil elements to a driven feed roller. Another elongated opening is formed along a sidewall of the cartridge box for extraction of coil elements therethrough in endwise fashion under the influence of the feed roller.

16 Claims, 1 Drawing Sheet

CODED COIL ELEMENT CARTRIDGE

CROSS-REFERENCE TO RELATED APPLICATION

The preferred contemplated application for this invention is with an automated machine which applies spiral coil binding elements to sheet stacks. Such a machine is the subject of commonly assigned application Ser. No. 08/620,677 (Attorney Docket No. P95.1631), filed concurrently herewith on behalf of Thomas Battisti and entitled "Automated Spiral Binding Machine."

BACKGROUND OF THE INVENTION

The invention is in the field of sheet binding in which a sheet stack, typically paper, having prepunched holes along one side edge is bound by means of a spiral coil element threaded through the prepunched holes in the sheets. The invention concerns a cartridge arrangement for containing a multitudinous supply of like-size spiral coils which enables repetitive spiral coil binding operations wherein a single coil can be extracted from the cartridge supply for application to a respective sheet stack.

For spiral coil binding of a sheet stack, the operation has heretofore typically been performed manually. The operator retrieves a pre-cut spiral coil element and winds the element through the prepunched holes along a side edge of a sheet stack. The supply of spiral coils is in the form of a loose arrangement, such as a box or pile of loosely arranged spiral coils.

There has long been a need for a commercially acceptable automated spiral coil binding machine for paper sheets. Recent development work has lead to a design for such a machine. Since the binding operation applying spiral coils to sheet stacks may be automated, there also arises the need for an arrangement permitting the automated delivery of spiral coils to the machine, avoiding the more time-consuming and inefficient manual handling of individual coils in feeding such a machine. This invention fills that need by providing an arrangement for supplying spiral coil elements to an automated binding machine which is adapted for machine handling and an automated coil binding system.

SUMMARY OF THE INVENTION

For expected use in an automated spiral coil binding system, there is provided a box-like cartridge, disposable or non-disposable, to contain a quantity of cut to length spiral coil elements and which allows the spiral coils to be removed one at a time from the cartridge for binding a sheet stack. The spiral coils can be packaged in the cartridge either in a single layer or in a double layer to increase packaging density. Cartridge material is anticipated to be paperboard for disposal, but any suitable material would suffice. The cartridge box contains a barcode label designating the particular size, preferably in terms of diameter, of the coils contained in the cartridge. An opening or openings are provided in the cartridge box to allow an extraction roller to contact the individual spiral coil to be rotated and extracted from the cartridge. Rotating the spiral coil advances the coil out of the cartridge to a positioning station for threading through the prepunched holes and binding the sheet stack. A rail arrangement, preferably made of plastic molded material, is fitted in the cartridge box for individually containing and arranging the spiral coils, and for aligning and supporting the spiral coils relative to the cartridge opening or openings for manipulation by the extraction roller. In addition to the extraction roller opening or openings being provided in the cartridge box for access by the extraction roller, such opening or other openings would also be provided for access by a coil sensing device to convey to the binding machine information on the presence or exhaustion of spiral coils.

DETAILED DESCRIPTION OF THE PREFERRED EMBODIMENT

Figure 1:
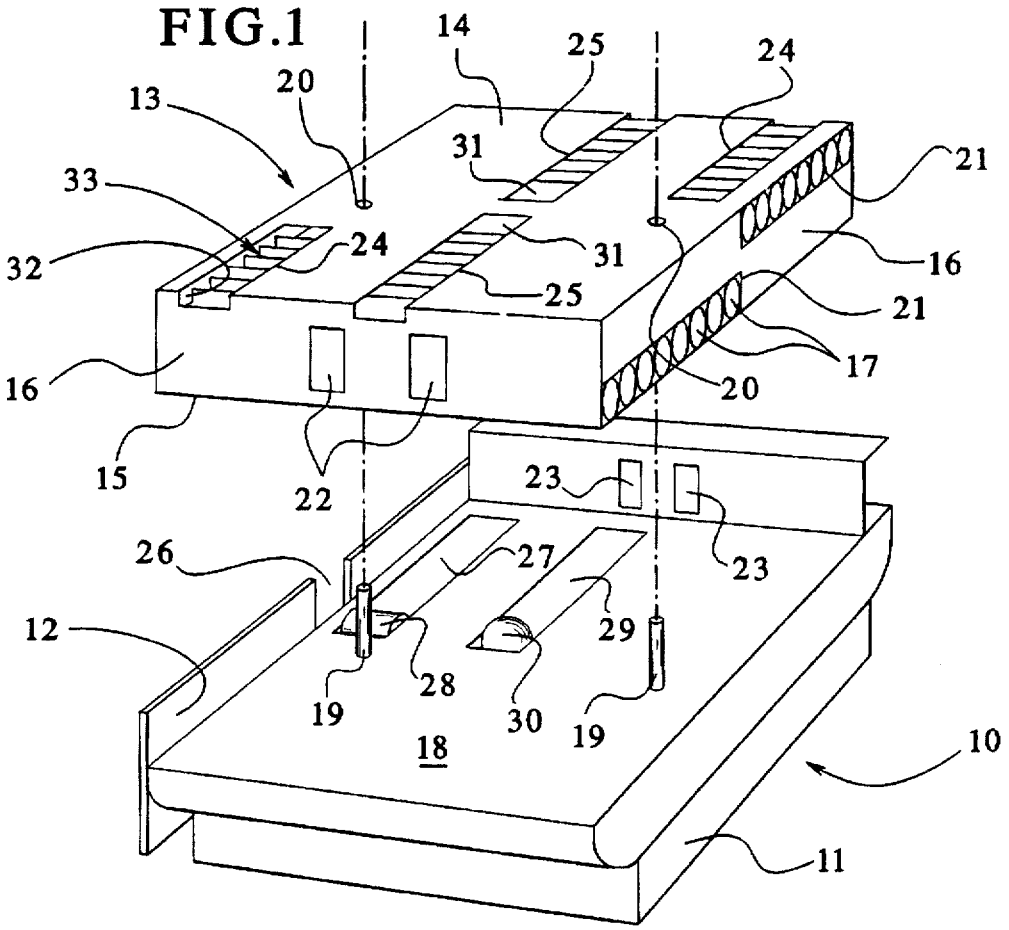
FIG. 1 is a perspective view of an automated coil feeder mechanism and associated coil supply cartridge incorporating the principles of the invention.

A specific embodiment incorporating the principles of the invention is herewith described with reference to the accompanying drawings. In accordance with invention, the described arrangement would be expected to be used with an automated spiral coil binding machine, the product of which is a spirally bound sheet stack such as is commonly known and recognized in the art.

For use with an automated spiral coil binding machine, an automated system in the form of a motor-driven coil feeder 10 is contemplated which serves to receive a supply of multi-spiral coil elements and extract such coils one at a time from the supply for feeding to the binding machine. As concerns the feeder system 10, a suitable kinematic machine arrangement of shafts and gearing powered by conventional electric motors controlled from a microprocessor using well-known encoders as part of the drive system would be well-within the engineering purview of those skilled in the art to bring about the intended movements without departing from the scope and spirit of the invention.

The feeder 10 is formed with a flat stationary base 11 intended for placement on a table top. A mounting plate 12 serves to connect the feeder 10 with the binding machine. A box-like cartridge 13 is provided which may be made of paperboard or other material, and which may be disposable or non-disposable. The cartridge 13 serves as a container having a top surface 14, a bottom surface 15, and opposed sidewall surfaces 16 extending therebetween for defining an interior storage space. The cartridge container 13 is prepacked to contain a supply of individual spiral coils 17, each of which is a pre-cut length defined by a plurality of substantially equally spaced spiral turns thus producing a linear element having a longitudinal axis about which the coil spirals. The coils 17 are made of PVC, or other material. Within the cartridge container 13, the coils 17 are arranged such that their longitudinal axes are parallel to each other. As a preferred embodiment, the cartridge container 13 is formed with separated upper and lower layers (defining planes which are parallel and offset from one another), and two separated sections in each layer, such that the cartridge container 13 is arranged to carry quadruple quantities of coils 17. Preferably, all of the coils 17 in a particular cartridge container are alike, having, for example, the same or similar spiral diameter dimension and/or length.

The cartridge container 13 is sized and shaped to fit onto a movable tray 18 in the feeder. A set of pins 19 are upstanding from the tray, and the cartridge container 13 is formed with a corresponding set of holes 20 in its top and bottom surfaces such that the box can be positioned onto the set of pins 19 and thus registered upon the tray 18. Elongated exit openings 21 are provided on the sidewalls of the cartridge for each set of coils contained in a partitioned section. Each elongated exit opening extends lengthwise transversely of the longitudinal axes of the coils which with that opening is associated, and exposes end portions of those coils.

The exit openings 21 are kittycorner from each other on each side of the box between the two vertical layers of coil quantities. At the opposed front and back ends of the box 16, there are a pair of barcode labels 22, which will be read by a pair of barcode readers 23 positioned at one end of the tray 18. This barcode labeling serves to designate the particular size, preferably in terms of spiral coil diameter and/or length, of the coils contained in the cartridge box 16, which information may be used by the system microprocessor. Each of the top and bottom surfaces of the cartridge container 13 is provided with an elongated exterior opening 24 and a further elongated exterior opening 25. Each of the openings 24 and 25 extends lengthwise transversely of the longitudinal axes of the coils with which that opening is associated, and exposes intermediate portions of these coils. The opening 24 coincides in length with the exit opening 21, both exposing the full complement of coil storage rows available for that coil section. The opening 25 is one empty space greater in length than opening 24. Because the cartridge container 13 is arranged to carry a quadruple supply of coils 17 for use in the binding machine, each quadrant supply of coils within the container 13 can be accessed in the feeder by virtue of the operator turning the container around front-to-back, turning the container upside down, and then again turning the container front-to-back.

The tray 18 is supported on a suitable translatable mover mechanism for indexable forward and rearward movement. Within the mounting plate 12 facing the binding machine is a cut-away to define an extraction opening 26 which coincides with the exit opening 21 exposing the ends of the quadrant supply of coils 17. There is a cut-out 27 formed in the tray 18 which coincides with the opening 24 of the cartridge container 13 when situated on the tray. This tray cut-out 27 is proximate the extraction opening 26. Positioned within the cut-out 27 and protruding upward from this cut-out for engagement with the spirals of a respective coil exposed by the opening 24 is a rotatably driven feed roller 28, preferably made of rubber. The rotational axis of the feed roller 28 is parallel to the longitudinal axes of the coil elements. On the other side of the tray cut-out 27 from the extraction opening 26 is a parallel cut-out 29 in the tray, which cut-out coincides with the opening 25 when the container 13 is positioned on the tray. Each of the cut-outs 27 and 29 are of a length equal to that of the opening 25.

As contemplated for the invention, there may be provided a biased trigger-type sensor switch having open and close settings between opposed ends of its bias stroke. This sensor serves to sense the availability of coils in the container 13. The sensor could be disposed for engagement by coils exposed through the opening 24, to be affected by coils passing thereacross during indexing of the tray 18, such as for counting the coils, or controlling indexing movement of the tray 18, or signal activation of the feed roller 28. The preferred embodiment for this sensor arrangement is as follows.

Aligned with the feed roller 28 crosswise of the tray 18, is a raised sensing switch 30, preferably in the form of a ball switch, which normally extends upward protruding through the tray cut-out 29 in its open position, but which is depressible to a lowered position upon engagement by a coil through the container opening 25, causing the sensing switch to close.

With the cartridge container 13 suitably positioned on the tray 18 of the feeder 10, the feeder operates as follows. The tray 18 is indexed to a full forward position, such that the lead coil in the cartridge container quadrant being accessed will be that coil proximate the far end of the container as viewed in FIG. 1. The tray 18 is subsequently intermittently indexed rearward for delivering a coil at a time, as needed, until the vacant interior space 31 in opening 25 overlies the sensing switch 30, whereupon the feeder 10 ceases operation (preferably signaling a coil exhaustion condition), and replenishment (by turning or replacing the cartridge container) and re-starting the feeder is necessary.

Figure 2:
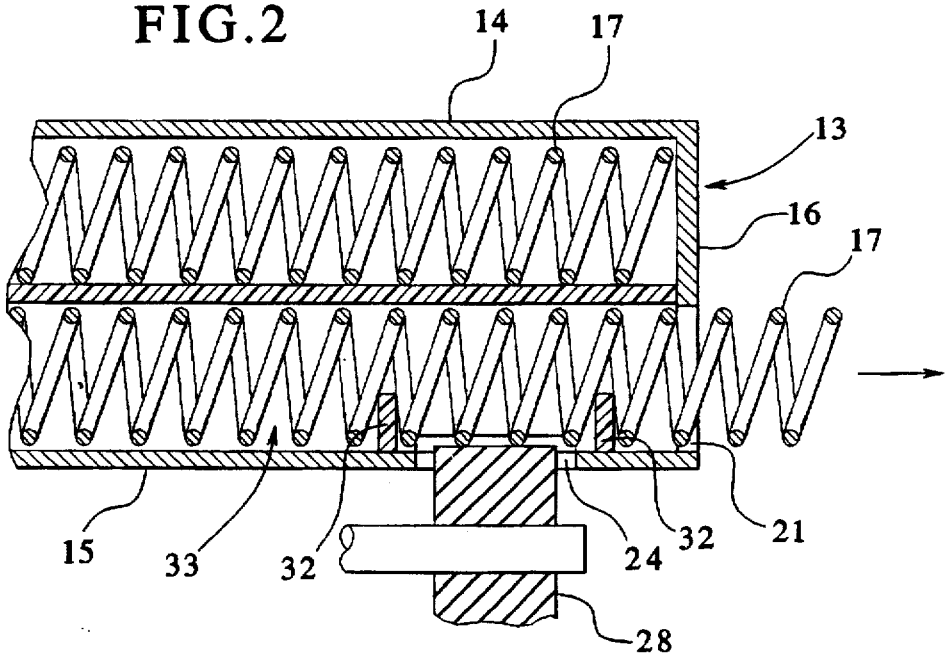
FIG. 2 is a side-elevational, cross-sectional view illustrating operation of the extraction roller upon a coil in the coil supply cartridge in accordance with the principles of the invention.

It is contemplated to program the microprocessor control of the system drive for a delay in halting the rearward indexing movement of the tray 18 despite the presence of a coil closing the sensing switch 30, in order to more properly position larger size coils relative to the feed roller 28 and extraction opening 26. Such a delay instruction would be triggered by the information read from the barcode label 22. However, essentially speaking, when the feeder is signalled to operate, the tray 18 moves rearward until stopped by a coil overlying the sensing switch 30. As shown in FIG. 2, this coil then also overlies the feed roller 28. The feed roller 28 then rotates, its circumference contacting the outside diameter of the coil and spirally feeding the coil endwise out of the cartridge container through the exit opening 21. In order to enable feed roller rotation to translate the coil out through the exit opening 21, a stationary cross rail(s) 32 running between adjacent spiral coils of the coil 17 and extending interiorly of the adjacent spirals in the coil and transversely of the longitudinal axis of the coil are situated in the cartridge container 13 on opposed sides of the cut-out opening 24 in each coil channel. Each cross rail 32 protrudes partially into the path of coil withdrawal through the exit opening 21. Preferably, the cross rails 32 are formed as part of a plastic-molded rail structure 33 for individually separating and containing the coils in the container 13 in contiguous longitudinal channels. The stationary cross rail(s) 32 in the cartridge container 13 act as a thread in conjunction with the spiral of the coil during feed roller 28 engagement and rotation of the coil, akin to a stationary nut and bolt.

Although the present invention has been described with reference to a specific embodiment, those of skill in the art will recognize that changes may be made thereto without departing from the scope and spirit of the invention as set forth in the appended claims.

I claim as my invention:

1. For use in a system for handling a supply of multi-spiral coil elements and extracting said coil elements one at a time from said supply:

a container having a top surface, a bottom surface, and opposed sidewall surfaces extending therebetween for defining an interior space;

a quantity of spiral coil elements disposed in said interior space, each coil element exhibiting a longitudinal axis about which its coil spirals parallel to the longitudinal axes of the other coil elements;

a first elongated opening in at least one of said top and bottom surfaces extending lengthwise transversely of the longitudinal axes of said coil elements and exposing intermediate portions of said coil elements; and a second elongated opening in at least one of said sidewall surfaces extending lengthwise transversely of the longitudinal axes of said coil elements and exposing end portions of said coil elements.

2. The invention of claim 1, wherein all said coil elements of said quantity of coil elements have a similar spiral diameter dimension.

3. The invention of claim 1, wherein a barcode label appears on at least one of said top, bottom, and sidewall surfaces, said barcode label relating to said quantity of coil elements and identifying at least one dimension applicable to all said coil elements in said quantity of coil elements.

4. The invention of claim 1, wherein said first and second elongated openings are associated with said quantity of coil elements as a first quantity of coil elements, and a second quantity of coil elements disposed in said interior space with their longitudinal axes parallel to one another and associated with third and fourth elongated openings formed with respect to said second quantity the same as said first and second openings are formed with respect to said first quantity.

5. The invention of claim 4, wherein said first and second quantities of coil elements extend in respective parallel planes which are offset from one another.

6. The invention of claim 4, wherein said first and second quantities of coil elements extend in a common plane.

7. The invention of claim 1, wherein said system has a driven member for extracting one said coil element out from said container, said driven member engaging said one coil element for extraction through said first opening and passing said one coil element out through said second opening.

8. The invention of claim 7, including a stationary rail fitted in said container adjacent said first opening and extending transversely of the longitudinal axis of said one coil element, said rail running between adjacent spiral coils of said one coil element and interiorly of said adjacent spirals in said one coil element.

9. The invention of claim 8, wherein said driven member comprises a roller having a rotational axis parallel to said longitudinal axis of said one coil element, the circumference of said roller protruding through said first opening into engagement with the exterior of the spirals of said one coil element.

10. The invention of claim 7, wherein said system has a sensor for detecting the availability of said one coil element for extraction by said driven member.

11. The invention of claim 7, wherein said system has a movable tray supporting said container to pass said first opening over said driven member.

12. The invention of claim 1, wherein at least one of said top and bottom surfaces has a separate further opening extending lengthwise transversely of the longitudinal axes of said coil elements and exposing further intermediate portions of said coil elements.

13. The invention of claim 12, wherein said system has a sensor for engaging said coil elements by protruding through said further opening to individually detect the presence of said quantity of coil elements.

14. The invention of claim 13, wherein said further opening is of a length in excess of the accumulated transverse distance defined by said quantity of coil elements; and said sensor protrudes into vacant interior space formed by said excess length of said further opening to detect exhaustion of said quantity of coil elements.

15. The invention of claim 12, wherein said further opening is of a length greater than the length of either of said first and second openings.

16. The invention of claim 1, wherein said coil elements in said quantity are separated from each other by rails fitted in said container, said rails extending parallel to said longitudinal axes of said coil elements.

* * * * *